United States Patent [19]

Herard

[11] Patent Number: 4,856,446

[45] Date of Patent: Aug. 15, 1989

[54] COLLAPSIBLE FISHING AND/OR LEISURE BOAT

[76] Inventor: Yves Herard, 2, place de la mairie, F-81380 Lescure, France

[21] Appl. No.: 156,625

[22] Filed: Feb. 17, 1988

[30] Foreign Application Priority Data

Feb. 18, 1987 [FR] France ..... 87 02354

[51] Int. Cl.[4] ..... B63B 7/00

[52] U.S. Cl. ..... 114/61; 114/364; 114/352

[58] Field of Search ..... 114/61, 123, 283, 255, 114/343, 364, 362, 352

[56] References Cited

U.S. PATENT DOCUMENTS

| | | | |
|---|---|---|---|
| 2,748,740 | 6/1956 | Villar | 114/61 |
| 2,984,845 | 5/1961 | Gregoire | 114/61 |
| 3,134,113 | 5/1964 | Boyington et al. | 114/61 |
| 3,864,770 | 2/1975 | Zeilinger | 114/362 |
| 3,968,532 | 7/1976 | Bailey | 114/61 |
| 4,062,299 | 12/1977 | Smith | 114/364 |
| 4,624,209 | 11/1986 | Loffler | 114/61 |

FOREIGN PATENT DOCUMENTS

| | | |
|---|---|---|
| 0012288 | 6/1980 | European Pat. Off. . |
| 2554410 | 5/1985 | France . |

OTHER PUBLICATIONS

Brochure "Cataminus" R. C. Albi 87 B 177.

*Primary Examiner*—Sherman D. Basinger
*Assistant Examiner*—Stephen P. Avila
*Attorney, Agent, or Firm*—Spencer & Frank

[57] ABSTRACT

A knockdown fishing and/or leisure boat comprises two identical floats on which rests a deck. Each of the floats is provided, in its superior median axis, with a plurality of threaded bolts evenly spaced to assure dismountable attachment of a same quantity of identical deck planks connecting the two floats parallel to each other. This is accomplished by means of an opening provided at each extremity of the planks to allow the threaded bolts of the float to pass through. A manually turnable nut is threaded on each bolt to tighten each plank to the floats.

4 Claims, 2 Drawing Sheets

COLLAPSIBLE FISHING AND/OR LEISURE BOAT

The present invention relates to the boat industry and concerns, more particularly boats intended for fishing and/or leisure.

Currently, boats of this type are available in the form of crafts (of wood, fiber glass, plastic, iron, etc . . .) or in the form of catamarans that can be converted into motor boats for fishing trips as described in French Patent No. 2,554,410. In this patent the conversion operation consists in replacing the catamaran canvas, which is stretched over a metallic frame connecting the two floats, with a more rigid plank which is fastened to said frame. Its originality relates primarily to the equipment, which permits substituting the canvas on the frame for a plank or conversely.

In general, these convertible crafts or catamarans demonstrate numerous shortcomings as to their stability, relative comfort, transportation, and storage (because in their normal environment they are subject to pillaging and/or robbery).

Based on these facts, the applicant has invented a knockdown fishing and/or leisure boat which overcomes all the disadvantages mentioned above.

According to the invention, this boat, classically composed of two identical floats on which rests a deck, is characterized in that each of these floats is provided in its superior median axis, with n threaded bolts evenly spaced to ensure the fastening of n removable deck planks for the purpose of connecting the two floats parallel to each other. An opening provided at each end of said planks permits threaded bolts from the floats, capped with manually turnable nuts, to pass through, allowing the planks to be screwed to the two floats.

As compared to the catamaran of French Pat. No. 2,554,410, the boat of the present application offers the great advantage of eliminating the use of a rigid metal frame, since the planks of the deck serve as cross bars and deck on said floats. In addition, the modular aspect of the designed deck made of n planks offers the great advantage of facilitating handling, transportation, and assembly of the boat.

By virtue of its design, the boat of the present invention demonstrates very good distribution of equilibrium, which gives it very good stability against tipping, especially for hunters and fishermen sitting on it.

Besides being easy to use, this boat is very easily disassembled and transported because it can be mounted on a car rack, eliminating the inconvenience of towing, and therefore limiting its remaining in one place. Moreover, because of the many identical elements which comprise this boat (two floats, four planks for the deck, manually turnable nuts, fishing and/or recreational accessories), industrial mass production is particularly indicated for the actual construction of such a boat.

Presenting this boat in the form of a "kit" or "ready for assembly" considerably reduces its unwieldiness for transport and also permits development of new ways of marketing in this field. In fact, sales of the boat can be ensured by employing classical marketing techniques such as used with other, less bulky products, for example, mail orders through specialty journals for fishing, hunting, recreation, etc . . .

According to one particularly advantageous characteristic of the invention, the tapped holes are judiciously distributed in each plank of the deck for dismountable installation of fishing and/or recreational accessories and are equipped for this purpose with an appropriate threaded male part. Thus, it is possible to install in these holes storage benches, sailing masts, mooring anchors, paddle holders, forked supports for fishing rods, maintenance handles etc . . . which can, of course, also be furnished as options with said boat.

Having cited the general concepts of the invention in their most elementary form, other characteristics and other advantages of the present invention will become clearer from the following description and accompanying drawings, giving a detailed example for purposes of illustrating a method for constructing a fishing and/or leisure boat which conforms to the fundamental concepts of the invention.

As illustrated, the boat comprises two identical floats 1*a* and 1*b* made of high density polyethylene on which rest four deck planks 2, 3, 4, and 5, which are made of polyester reinforced with fiber glass molded by hot pressing.

Figure 2:
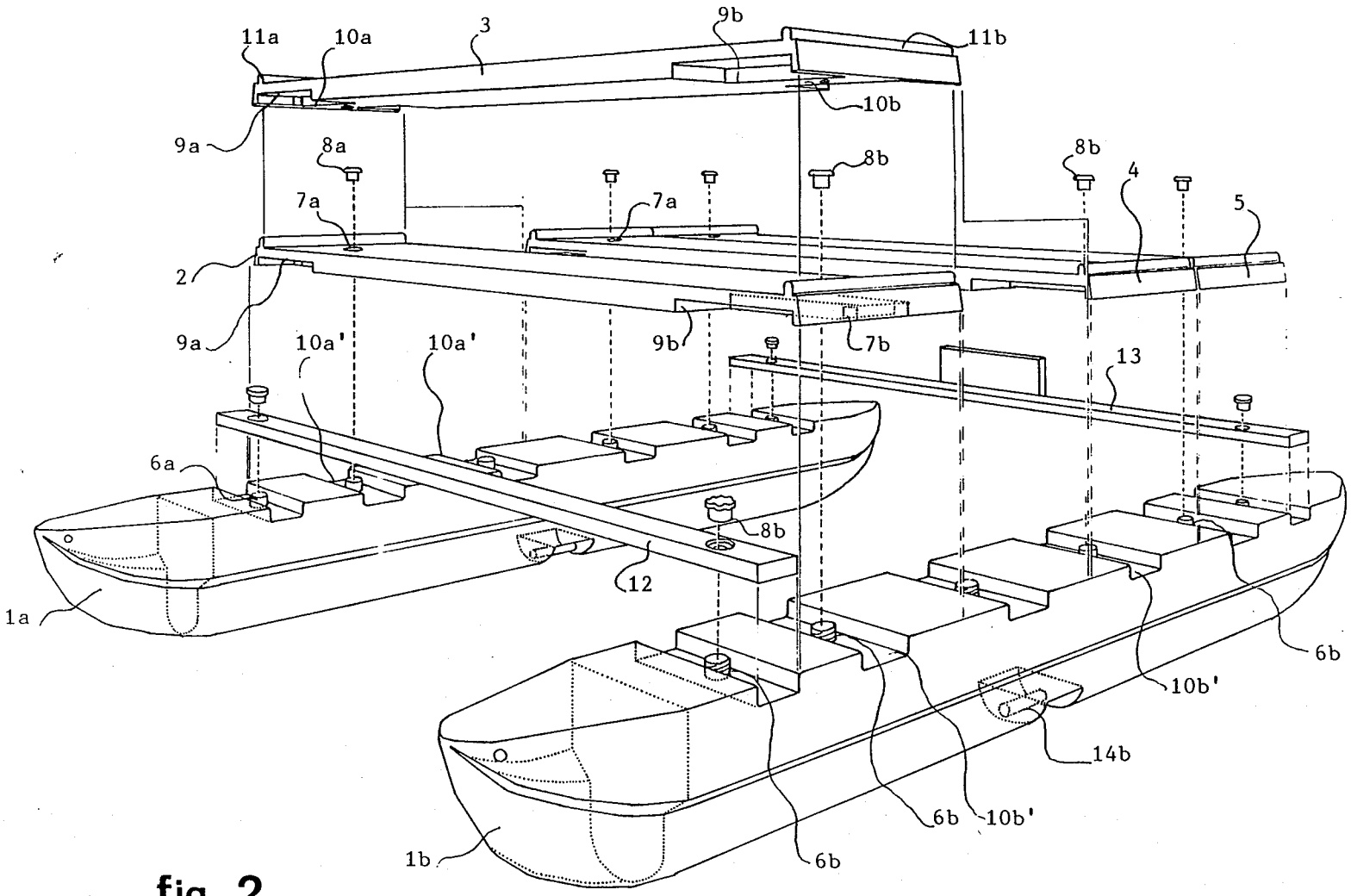
FIG. 2 is an exploded perspective view of the boat as shown in FIG. 1.

As one can see in more detail in the drawing of FIG. 2, the two floats 1*a* and 1*b* are each provided in their superior median axis with six threaded bolts 6*a* and 6*b*. The openings 7*a*, 7*b* engage the four evenly spaced central bolts attached to the two extremities of the four deck planks 2, 3, 4 and 5, and the manually turnable nuts 8*a*, 8*b* permit said planks to be removably screwed to the floats 1*a* and 1*b*.

These planks which cover the entire width of the floats 1*a* and lb are placed side by side on the two floats in order to form a uniform deck (see FIG. 1) and they are preformed at their two extremities according to a shape which strengthens their connection with the two floats.

On the one hand, they comprise on their lower face a recess 9*a*, 9*b* which permits the upper part of the floats to engage said planks over a certain thickness of said planks.

On the other hand, they take on, in their portion delimited by the recess 9*a*, 9*b*, the profile of a T so that the vertical branch of said T 10*a*, 10*b* is going to be lodged in a rectangular recess 10*a*', 10*b*, provided in the upper part of the floats 1*a*, 1*b*, and extending over the width of the latter and both sides of each threaded bolt 6*a*, 6*b*. Thus, the vertical branch of the T constitutes a narrowed plank portion which fits into a respective rectangular float recess 10*a*', 10*b*'.

Figure 1:
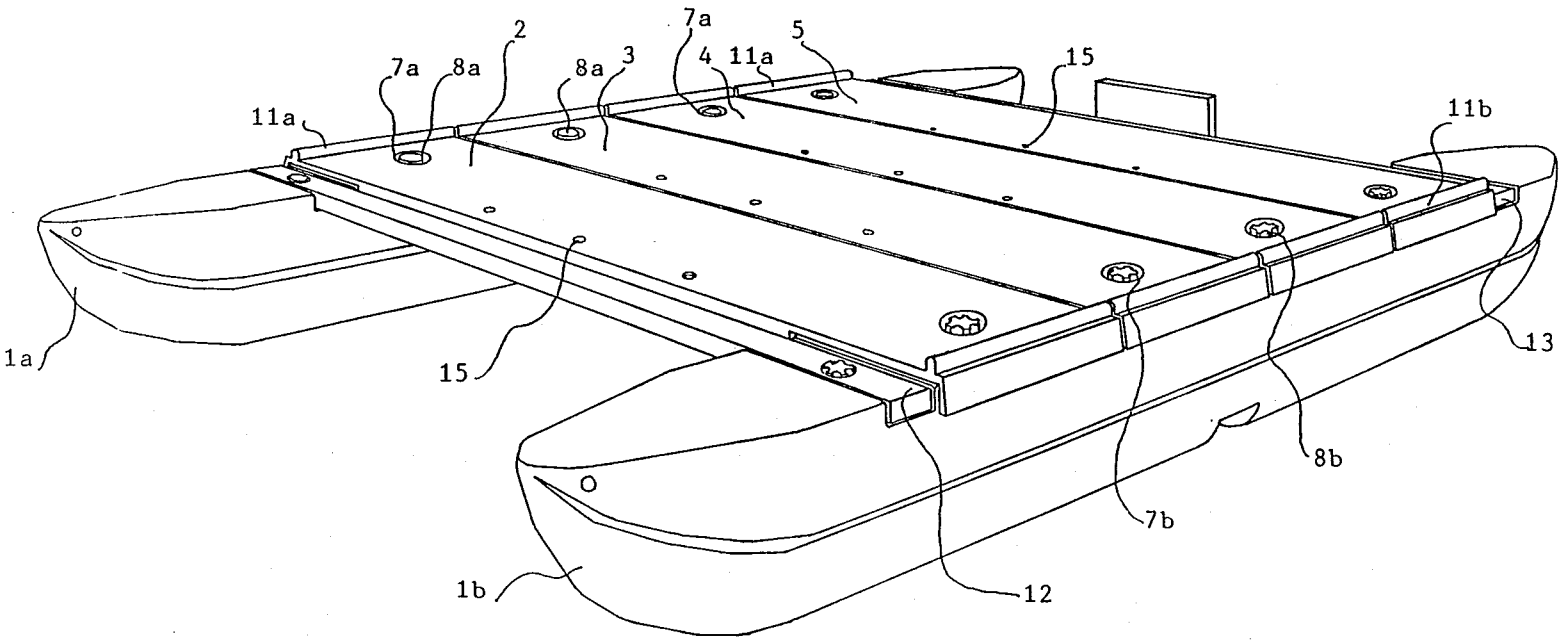
FIG. 1 is a perspective view of a boat according to a preferred embodiment of the invention.

Finally, the extreme upper edges of said planks have a preformed shoulder 11*a*, 11*b*, delimiting a continuous border when the planks are assembled on the floats 1*a* , 1*b*, serving as a barrier (see FIG. 1). Advantageously, a cavity (not shown in the drawings) can be provided below the shoulders 11*a*, 11*b*, in order to allow stacking and storing of the four deck planks 2, 3, 4 and 5, and for clean-up operations and/or transport.

This configuration of the plank extremities 2, 3, 4, and 5 permits the planks and the floats to obtain an overlapping, tight connection which eliminates the presence of a rigid frame. However, two cross bars 12 and 13 made of a more rigid material than that of the deck planks can be secured to the floats 1*a* and 1*b*, to the front and the rear of the deck, according to the same dismountable attachment as that of said planks in order to reinforce the indeformability of the boat. The rear coupling bar 13 can be used as supporting bar for a motor ensuring the propulsion of the boat.

According to a particularly advantageous characteristic of the invention, the two floats 1*a* and 1*b* are provided in their central inferior portion with a cut out, outlining a transport handle 14*a* and 14*b*.

According to another particularly advantageous characteristic of the invention, the tapped holes 15 (see FIG. 1) are evenly spaced in each plank of the deck to allow for removable installation of fishing and/or leisure accessories (not shown) which are equipped for this purpose with an appropriate threaded male part.

Thanks to its modular aspect and to its ready-for-assembly and ready-for-disassembly characteristic, the boat which has been described and illustrated above will have numerous applications in the area of fishing, hunting, touring, and recreation,

I claim:

1. A knockdown catamaran comprising (a) two identical floats, each having a horizontal float length extending parallel to a direction of forward travel of the catamaran; a horizontal float width extending perpendicularly to the float length; an upper horizontal float surface; a plurality of rectangular float recesses provided in the float surface along said float width; said float recesses being spaced form one another parallel to said float length; each said float recess having a length parallel to said float width and a width parallel to said float length;

(b) a threaded bolt being affixed to each float in each said float recess and extending substantially perpendicularly to said float surface;

(C) a plurality of identical planks each having a plank length, a plank thickness, two opposite ends, a top surface, a bottom surface and two rectangular plank recesses provided in said bottom surface at each said end and each having a depth less than the plank thickness; said two plank recesses at each end being spaced in a direction perpendicular to said plank length to define therebetween a narrowed plank portion having a thickness equalling said depth; and a throughgoing hole provided in each said narrowed plank portion; the narrow plank portion at one end of each said plank readily removably fitting into a separate one of said float recesses of one of said floats and the narrow plank portion at the other end of each said plank readily removably fitting into a separate one of said float recesses of the other of said floats; said planks, when received by respective said float recesses, forming a continuous deck and rigidly connecting said two floats with one another by the fit between respective said float recesses and respective narrowed plank portions; and (d) a manually turnable nut threadable on each said threaded bolt projecting into a respective said hole of said plank when fitted into respective said float recesses, whereby said planks are tightenable to and readily removable from said floats.

2. A catamaran as defined in claim 1, further comprising shoulders formed at each said end of each said plank; each shoulder projecting from the top surface of the plank and extending parallel to the plank width; said shoulders forming a continuous, upstanding border of said deck.

3. A catamaran as defined in claim 1, further comprising tapped holes provided in at least some of said planks at the top surface thereof for receiving complementally threaded pins of accessory equipment.

4. A catamaran as defined in claim 1, wherein each said float has a lower side situated below said upper horizontal float surface; further comprising a cutout provided in said lower side in a mid portion of said float length, and a handle affixed to each float and bridging said cutout for manually carrying each float on land.

* * * * *